United States Patent [19]

Rombouts

[11] Patent Number: 4,520,789

[45] Date of Patent: Jun. 4, 1985

[54] SUPPORTS FOR HEATING BODIES INTENDED FOR ANNEALING FURNACES

[76] Inventor: André H. Rombouts, Rue de la Colline, 97, Ivoz-Ramet, Belgium, B-4120

[21] Appl. No.: 560,984

[22] PCT Filed: Mar. 25, 1983

[86] PCT No.: PCT/BE83/00008

§ 371 Date: Nov. 23, 1983

§ 102(e) Date: Nov. 23, 1983

[87] PCT Pub. No.: WO83/03428

PCT Pub. Date: Oct. 13, 1983

[30] Foreign Application Priority Data

Mar. 26, 1982 [LU] Luxembourg ..... 84040

[51] Int. Cl.[3] ..... F24C 3/00

[52] U.S. Cl. ..... 126/91 A; 432/209

[58] Field of Search ..... 126/91 A, 91 R; 432/209

[56] References Cited

U.S. PATENT DOCUMENTS

| | | | |
|---|---|---|---|
| 2,200,731 | 5/1940 | Woodson | 126/91 |
| 2,204,144 | 6/1940 | Moore et al. | 122/479 |
| 2,652,037 | 9/1953 | Lewis et al. | 122/510 |
| 2,822,798 | 2/1958 | Ipsen | 126/91 |
| 3,079,910 | 3/1963 | Bloom et al. | 126/91 |
| 3,920,383 | 11/1975 | Kerr | 126/91 A |

FOREIGN PATENT DOCUMENTS

| | | |
|---|---|---|
| 861541 | 10/1940 | France . |
| 487764 | 6/1938 | United Kingdom . |
| 1396796 | 6/1975 | United Kingdom . |

OTHER PUBLICATIONS

Gaz d'aujourd'hui, vol. 98, No. 9, Sep. 1974, Paris (FR), M. Douspis: "Une utilisation rationnelle de l'energie: le tube radiant a gaz", pp. 395–400.

*Primary Examiner*—Carroll B. Dority, Jr.
*Attorney, Agent, or Firm*—Fishman & Dionne

[57] ABSTRACT

The support of the invention permits the thermal expansion of the heating body (1) without having an adverse effect on the heating capacity or on the satisfactory operation of the furnace, by joining the tubular hairpin bends (2, 3) of the heating bodies (1) by means of a link (17), and by suspending a unit from a rest (18) sliding on a support arm (19) rigidly fixed to the wall of the furnace.

7 Claims, 2 Drawing Figures

SUPPORTS FOR HEATING BODIES INTENDED FOR ANNEALING FURNACES

The present invention relates to improved supports intended, in particular, for the heating bodies for annealing furnaces.

The heating bodies are used especially in furnaces for the continuous annealing of steel strips.

In such furnaces, a reel of steel strip is unwound and the steel strip passes through a degreasing device. It is dried by hot air before entering the furnace, which is divided into a heating section and a holding section. An inert atmosphere and a pressure greater than atmospheric pressure prevail therein in order to prevent any risk of contamination. The strip is guided, along its path through the furnace, between the walls consisting of heating bodies arranged in a staggered formation. On leaving the furnace this annealed strip is wound onto a reel.

From the article in "Gaz d'aujourd'hui", Volume 98, No. 9, September 1974, Paris (France), entitled "Une utilisation rationnelle de l'énergie: le tube radiant a gaz" ("A rational use of energy: the gas-fired radiant tube") by Messrs. DOUSPIS, pages 395 to 400, several types of radiant tubes (heating bodies) are known, namely straight tubes, single-hairpin tubes and recirculation tubes.

Other documents, such as U.S. Pat. No. 2,822,798, describe ways of fixing straight radiant tubes, and British patent application No. 487,764 and French patent application No. 861,541 show particular heating bodies or heating bodies of a particular shape.

British patent application No. 1,396,796 relates to a means of supporting U-shaped radiant tubes, consisting of a roller which is fixed to the wall of the furnace and over which the tube can slide without friction during thermal expansion.

This means has the disadvantage that it is bulky and that it cannot be used in furnaces for the continuous annealing of steel strips, for example.

U.S. Pat. No. 2,652,037 relates to supports for heating bodies (radiant tubes) in the form of a double hairpin bend, supported by a single rest fixed in a tube perpendicular to the radiant tube. In this application, the expansion of the radiant tube results in sliding over the rests, which is a cause of wear, microwelds and the like. Moreover, the tubes in which the rests are fixed are bulky and prevent the continuous passage of a steel strip which winds around the radiant tubes arranged in a staggered formation.

U.S. Pat. No. 2,204,144 relates to double-hairpin heating bodies supported or suspended and spaced apart by members permitting the expansion of the unit and acting as sliding points, which thus permit a relative movement of one element of the heating body relative to the other.

However, although the manufacturer indicates a limiting temperature of about 840° C. for the tube, an ambient temperature in the furnace of the order of 930° C., or even exceptionally of 1,040° C., is regularly recorded.

This excessive trend can result from an excessive speed of unwinding of the strip, from a product quality for which the heating rates were not intended, or from an irregularity in the servicing intervals, which leaves the furnace deprived of part of its heating capacity.

Under these conditions, the following disadvantages are observed:

the systems generally used to permit the expansion of the unit, which consist of spacing members also acting as sliding points, which thus permit a relative movement of one tube element relative to the other, no longer fulfil their role. Seizure, in particular, is observed at the sliding point supporting the upper hairpin bend, and this is due to microwelds generated in particular by an excessively high temperature. Swelling of the upper tube of the hairpin heating body then takes place, which causes off-centring of the burner flame.

As a result of an excessively high temperature, the rest firmly fixed to the outer wall of the furnace becomes deformed and introduces a torque, which causes the heating body to buckle.

A similar torque can also be generated by secondary tensions created during the production of the welds between the tubular elements and the bends, which tensions would be released the first time the heating body was ignited and/or after a repair.

The aim of the present invention is to solve these problems by providing a support device for heating bodies for annealing furnaces, permitting the free expansion of the heating body and totally eliminating the risk of flow of the free end, without having an adverse effect on its heating capacity or on the satisfactory operation of the furnace, which support device comprises a link joining the two outer hairpin bends of the heating body to one another, and a rest for the upper hairpin bend, sliding on a tubular support arm rigidly fixed in the wall of the furnace, permitting displacements in the sliding direction of this rest. The round shape of the rest and of the support permits automatic centring of the heating body, and the substantial play between these components makes positioning very easy.

The link joining the two "hairpin" bends of the heating body permits a movement of the tube elements relative to one another and holds the lower hairpin bend to the upper hairpin bend by suspension. The sliding point which supported the upper hairpin bend on the lower hairpin bend is eliminated.

It is advantageous to weld gussets, fitted to the said link, onto the two outer hairpin bends of the heating body.

To prevent buckling due to the pressure on the outer wall of the furnace, the heating body is supported by a rest welded in its upper part and sliding on a support arm rigidly fixed in the wall of the furnace. The rest is advantageously chosen so as to permit displacements in the direction of the support arm, so that the heating body is not subjected to high stresses.

The support arm is advantageously tubular, is blocked at its inner end by a welded insert and is preferably filled with a cottonwool thermal insulator or other thermal insulator.

The invention together with its context will be understood more clearly with the aid of the figures.

Identical reference numbers will be used for identical or similar elements in both figures.

Figure 1:
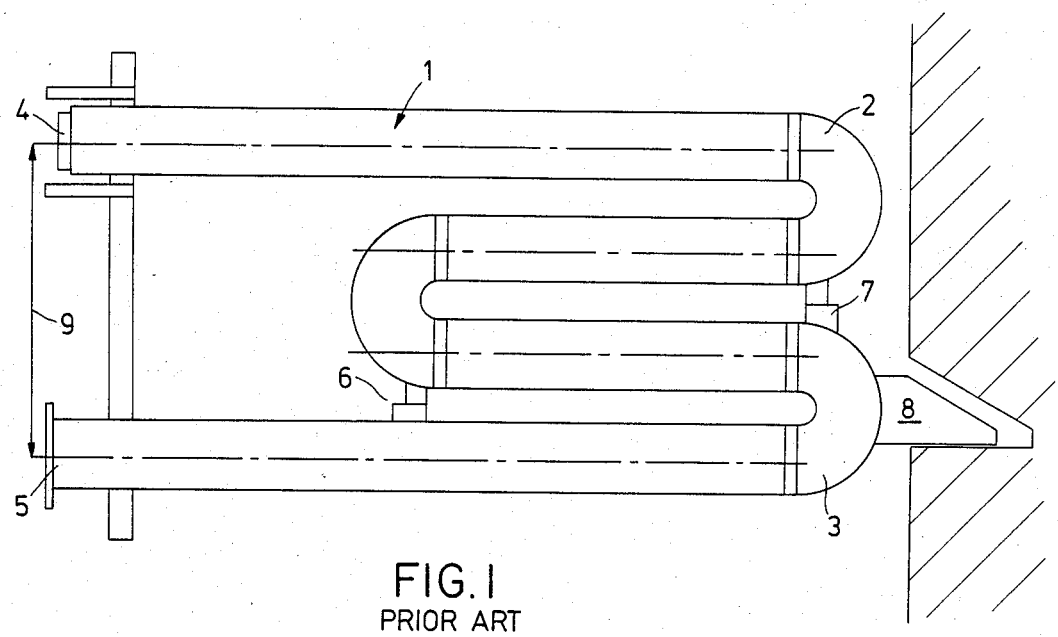
FIG. 1 PRIOR ART
FIG. 1 shows the support device of the state of the art.

The heating body 1, in the form of a double hairpin bend 2, 3, is made of stainless steel. Hot gases coming from a burner located at one end 4 pass through the heating body and are discharged at the other end 5, according to the embodiment belonging to the state of the art and illustrated in FIG. 1. Spacing members (6, 7) prevent the two tubular elements from coming into contact during expansion. They also permit relative sliding of the tubular elements of the heating body.

A third rest S, housed in the outer wall of the furnace, keeps the heating body in equilibrium so that it does not collapse at high temperatures, while at the same time permitting sliding due to the expansion. This arrangement has the disadvantage that accidentally high temperatures generate microwelds, especially at the point 7. Consequently, the upper tube is no longer free in its expansion, which causes it to swell and thus to become off-centred relative to the burner flame.

As a result of an excessively high temperature, that part of the rest 8 which is firmly fixed to the furnace becomes deformed and causes buckling of the heating body over the height 9.

Figure 2:
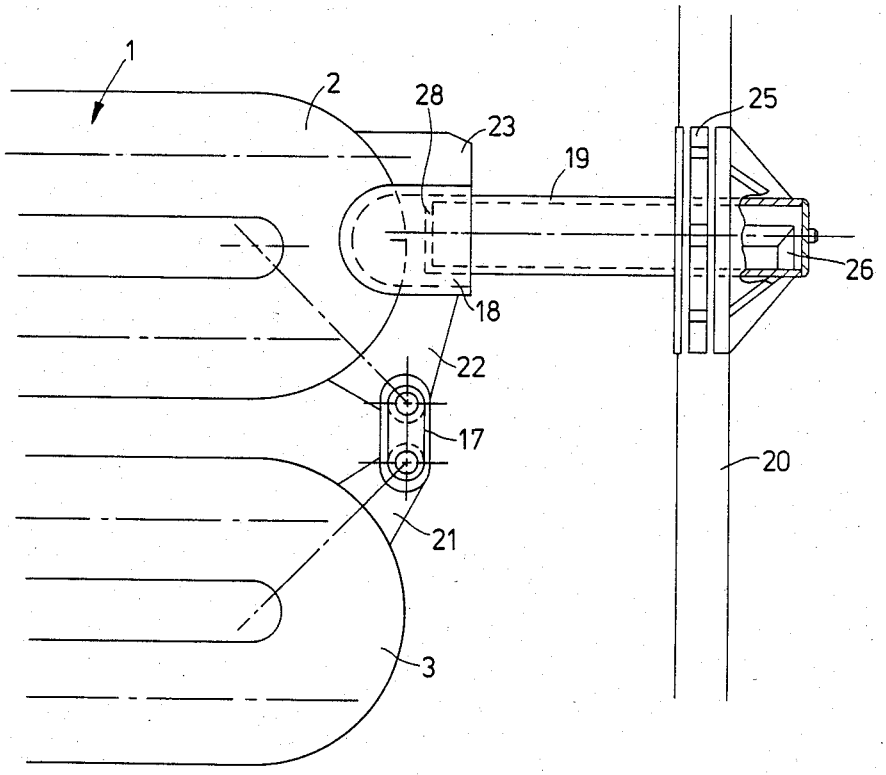
FIG. 2 shows a support according to the invention.

In an embodiment according to the invention (FIG. 2), the support 7 for the heating body 1 which is provided in the case of FIG. 1 is replaced by a link 17. The rest 18 advantageously slides on a support arm 19, preferably made of 25/20 or 37/18 stainless steel, rigidly fixed in the outer wall 20 of the furnace. This rest 18 is made so as to permit displacements in the direction of the support arm 19 and in directions perpendicular to the support arm 19, provided there is an advantageously chosen play.

Gussets 21, 22 and 23, preferably made of 25/20 stainless steel, have been welded to the tubular hairpin bends. The link 17 fixed by pivots between the gussets 21 and 22 renders the lower hairpin bend integral with the upper hairpin bend, while permitting movements due to thermal expansion.

The sliding rest, in the form of a cup 18, preferably made of 25/20 or 37/18 stainless steel, is welded to the hairpin bend and held by the gussets 22 and 23.

The support arm 19 is preferably tubular, blocked at its inner end by a welded insert 28 and fixed to the wall 20 of the furnace by means of an anchoring device 25. To reduce the thermal bridges, it is filled with a cotton-wool thermal insulator (or rockwool thermal insulator or the like).

In addition to eliminating the disadvantages of the other systems, the device of the invention also has advantages.

This new device can be positioned easily and, if appropriate, can be replaced from outside the furnace with the aid of conventional tools.

Masons are not needed to construct the device. The support arm can be equipped with a gauge 26, consisting, for example, of a 25×5 mm flat bar at right angles, which indicates the behaviour of this support inside the furnace from outside the latter.

The device of the invention makes it possible to direct all the expansion towards the inside of the furnace. Consequently, the end 4 of the upper tube can be welded to its baseplate; this makes it possible to avoid using complicated systems, frequently employed by manufacturers, for fixing the burners.

The device of the invention therefore gives the furnace a higher performance, without however increasing its price. The construction and maintenance service can save a great deal of time on account of the simplicity of construction and the easy access.

I claim:

1. A support for a heating body for an annealing furnace, permitting the expansion of the heating body (1) without affecting its heating capacity or the satisfactory operation of the furnace, wherein a pivotal link means (17) joins upper and lower hairpin bends (2, 3) of the heating body to one another, a cup-shaped rest being attached to said upper hairpin bend, a tubular support arm (19) rigidly fixed in the wall of the furnace, said cup-shaped rest being adapted to slide on said tubular support arm.

2. The support as claimed in claim 1, wherein said pivotal link means includes gussets (21, 22) welded onto the two outer hairpin bends (2, 3) of the heating body (1).

3. The support as claimed in claim 1, wherein the tubular support arm (19) is blocked at its inner end by an insert (28) and filled with a thermal insulator.

4. The support as claimed in claim 1, wherein the cup-shaped rest (18) is welded onto the upper hairpin bend (2) of the heating body and is held by gussets (22, 23).

5. The support as claimed in claim 1, wherein the cup-shaped rest (18) and the support arm (19) are made of 20/25 or 37/18 stainless steel.

6. The support as claimed in claim 1, wherein the gussets (21, 22, 23) and the link (17) are made of 25/20 stainless steel.

7. The support as claimed in claim 1, wherein the support arm (19) is equipped with a gauge (26) indicating, on the outside of the furnace, the behaviour of this support.

* * * * *